US006360633B2

(12) United States Patent
Pietras

(10) Patent No.: US 6,360,633 B2
(45) Date of Patent: Mar. 26, 2002

(54) APPARATUS AND METHOD FOR ALIGNING TUBULARS

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/771,534

(22) Filed: Jan. 29, 2001

Related U.S. Application Data

(63) Continuation of application No. 09/355,400, filed as application No. PCT/GB98/00282 on Jan. 29, 1998, now abandoned.

(30) Foreign Application Priority Data

Jan. 29, 1997 (GB) ..... 9701758

(51) Int. Cl.[7] ..... B25B 13/50
(52) U.S. Cl. ..... 81/57.34; 81/57.16
(58) Field of Search ..... 81/57.16, 57.34

(56) References Cited

U.S. PATENT DOCUMENTS

| | | | | |
|---|---|---|---|---|
| 2,450,934 A | | 10/1948 | Calhoun | |
| 2,692,059 A | | 10/1954 | Bolling, Jr. | |
| 2,794,661 A | | 6/1957 | Sears | |
| 3,041,901 A | * | 7/1962 | Knights | 81/57.34 |
| 3,380,323 A | * | 4/1968 | Campbell | 81/57.34 X |
| 3,447,829 A | | 6/1969 | Gyongyosi | |
| 3,518,903 A | * | 7/1970 | Ham et al. | 81/57.16 |
| 3,532,229 A | | 10/1970 | Scaggs | |
| 3,576,062 A | | 4/1971 | Matherne | |
| 3,589,105 A | | 6/1971 | Flick | |
| 3,635,105 A | | 1/1972 | Dickmann et al. | |
| 3,747,675 A | | 7/1973 | Brown | 166/237 |
| 3,881,375 A | | 5/1975 | Kelly | |
| 4,213,237 A | | 7/1980 | Whitting | |
| 4,246,809 A | * | 1/1981 | Keast et al. | 81/57.16 |
| 4,295,527 A | | 10/1981 | Russe | 166/315 |
| 4,357,843 A | * | 11/1982 | Peck et al. | 81/57.16 |
| 4,440,536 A | | 4/1984 | Scaggs | 414/22 |
| 4,492,134 A | | 1/1985 | Reinholdt et al. | 81/57.34 |
| 4,573,359 A | | 3/1986 | Cartensen | 73/761 |
| 4,599,778 A | | 7/1986 | Dreyfuss et al. | |
| 4,625,795 A | | 12/1986 | Boyadjieff | 166/77.5 |
| 4,697,830 A | | 10/1987 | Wood et al. | 285/27 |
| 4,739,681 A | | 4/1988 | Pietras | 81/57.16 |
| 4,921,386 A | | 5/1990 | McArthur | 414/22.51 |
| 5,060,542 A | * | 10/1991 | Hauk | 81/57.16 X |
| 5,259,275 A | | 11/1993 | Schulze-Beckinghausen | 81/57.16 |
| 5,667,026 A | | 9/1997 | Lorenz et al. | 175/162 |
| 5,730,471 A | | 3/1998 | Schulze-Beckinghausen | 285/18 |
| 5,842,390 A | * | 12/1998 | Bouligny et al. | 81/57.34 |
| 5,845,549 A | * | 12/1998 | Bouligny | 81/57.34 X |
| 5,850,877 A | | 12/1998 | Albright et al. | 166/77.51 |

FOREIGN PATENT DOCUMENTS

| | | |
|---|---|---|
| DE | 1 245 288 | 7/1967 |
| DE | 3 537 44471 | 1/1987 |
| GB | 2 210 912 A | 1/1988 |
| WO | PCT/US81/00661 | 5/1981 |
| WO | PCT/GB83/00097 | 3/1983 |

* cited by examiner

*Primary Examiner*—Joseph J. Hail, III
*Assistant Examiner*—Anthony Ojini
(74) *Attorney, Agent, or Firm*—Moser, Patterson & Sheridan, L.L.P.

(57) ABSTRACT

An apparatus for aligning a first tubular and a second tubular, in certain aspects, the first tubular extending through a power tong and the second tubular extending through a backup tong, the apparatus including positioning apparatus for guiding the power tong with respect to the backup tong and for maintaining said power tong and said backup tong in a certain juxtaposition during a tubular stabbing operation, the positioning apparatus including a plurality of spaced-apart locating rods projecting from one of said power tong and said backup tong and a plurality of spaced-apart blocks on the other of said power tong and said backup tong, and each block having a recess shaped to receive an end of one of the plurality of spaced-apart locating rods.

9 Claims, 12 Drawing Sheets

FIG. 3a
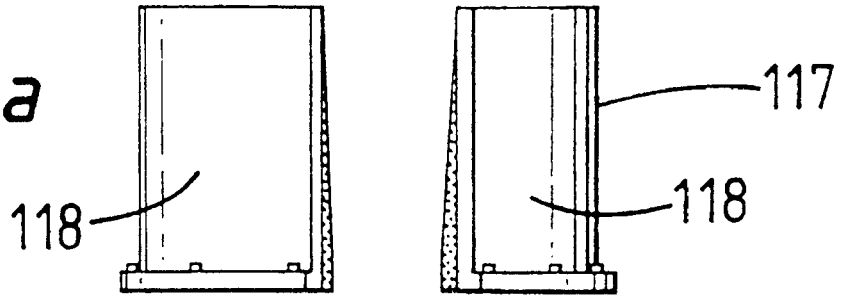
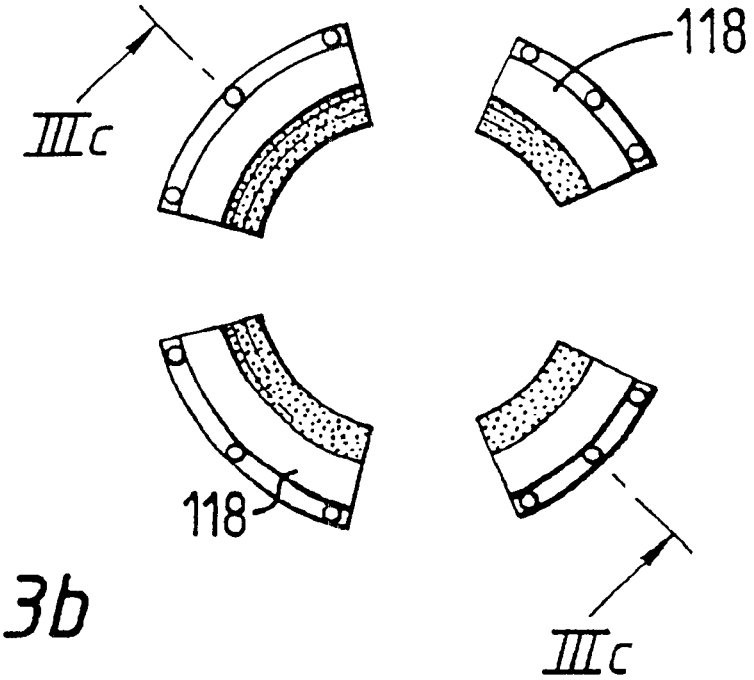
FIG. 3b
FIG. 3c
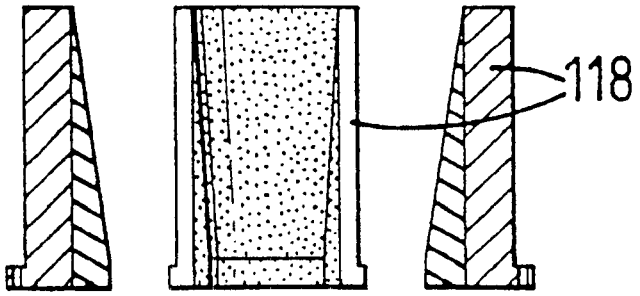

APPARATUS AND METHOD FOR ALIGNING TUBULARS

RELATED APPLICATION

This is a continuation of U.S. Ser. No. 09/355,400 filed Jul. 28, 1999 which is based on Application No. PCT/GB/00282 filed Jan. 29, 1998 both of which are incorporated fully herein for all purposes.

This invention relates to an apparatus and a method for aligning tubulars.

During the construction, maintenance and repair of oil and gas wells it is necessary to connect a large number of tubulars, for example lengths of drill pipe and casing. Conventionally the upper end of a tubular is provided with a threaded socket whilst the lower end is provided with a threaded pin which is slightly tapered.

In practice it is very easy for the pin of one tubular to be incorrectly inserted into the socket of an adjacent tubular with the result that the threads on one or both the pin and the socket can readily be damaged.

Considerable skill is required to correctly align tubulars and historically this task has been undertaken by a highly experienced rig-hand called a "stabber".

In order to facilitate correct alignment a device known as a "stabbing guide" is frequently used. One such stabbing guide comprises a plastic body member which can be mounted on the socket of a pipe held in slips. The plastic body member has a central passageway the upper part of which defines a funnel which leads into a lower passageway which is concentric with the socket. In use, as the upper tubular is lowered, its pin enters the funnel of the stabbing guide and then travels down the lower passageway into the socket. The stabbing guide (which comprises two semi-circular pieces hinged together around the socket) is then removed and the tubulars are screwed together and tightened to the required torque either by a power tong or a tong assembly comprising a power tong and a backup tong.

In order to simplify the stabbing operation the present invention provides an apparatus for aligning tubulars which apparatus comprises a guide mounted on one of a power tong and a backup tong.

In one embodiment said apparatus further comprises a socket centralizer mounted on said one of said power tong and said backup tong.

Preferably, said one of said power tong and said backup tong is said power tong.

In another embodiment, said apparatus comprises a power tong and a backup tong, wherein said guide is mounted on said power tong and means are provided to maintain said power tong and said backup tong in a certain juxtaposition during a stabbing operation.

Preferably, said means comprises locating rods on one of said power tong and said backup tong and blocks shaped to receive at least the ends of said locating rods on the other of said power tong and said backup tong.

Advantageously, said backup tong is provided with at least two prismatic jaw assemblies to locate said backup tong in fixed juxtaposition with respect to a tubular being gripped.

The present invention also provides methods for aligning tubulars as set out in claims 7 and 8 hereto.

For a better understanding of the present invention reference will now be made, by way of example, to the accompanying drawings, in which:

FIG. 1*a* is a side elevation of a conventional tong assembly;

FIG. 1*b* is a top plan view of the tong assembly shown in FIG. 1*a;*

FIG. 2*a* is a side elevation of a first embodiment of an apparatus in accordance with the present invention;

FIG. 2*b* is a top plan view of the apparatus shown in FIG. 2*a;*

FIG. 3*a* is a side view of the components of a guide forming part of the apparatus shown in FIGS. 2*a* and 2*b;*

FIG. 3*b* is a top plan view of the guide shown in FIG. 3*a;*

FIG. 3*c* is a section on line IIIc—IIIc of FIG. 3*b;*

Figure 1A:
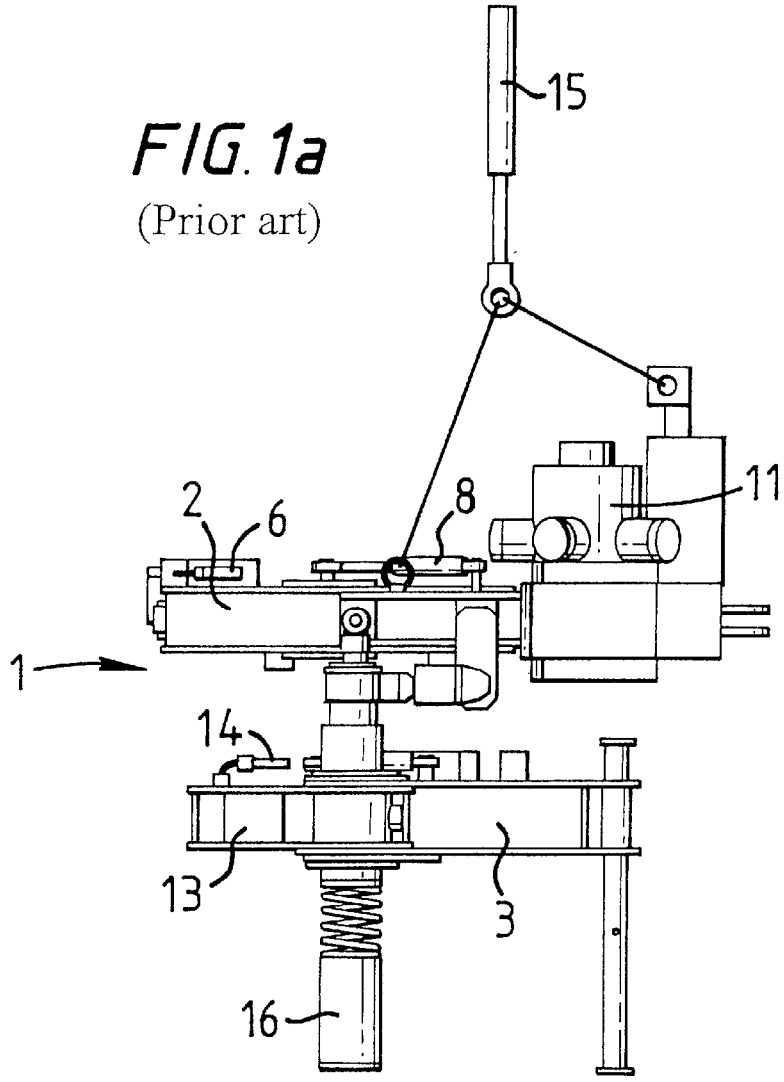
FIG. 1a (Prior art)
Figure 1B:
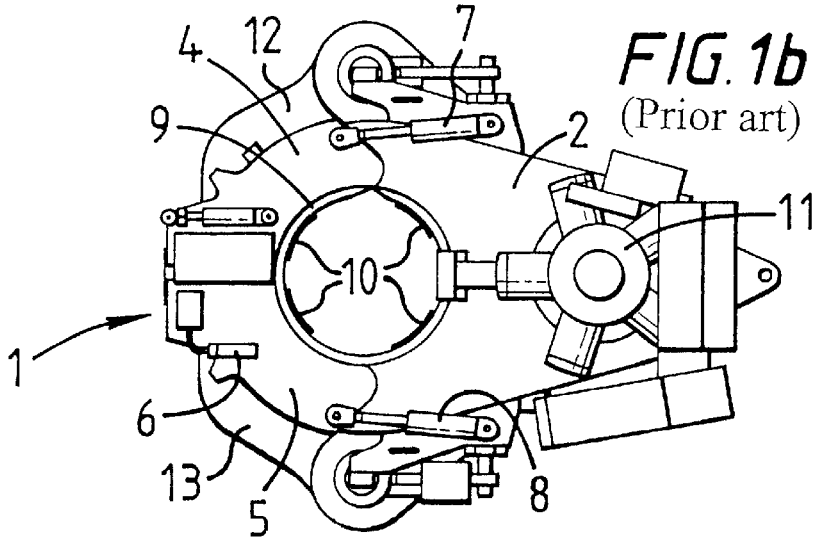
FIG. 1b (Prior art)

Referring to FIGS. 1*a* and 1*b* of the drawings there is shown a conventional tong assembly which is generally identified by the reference numeral 1.

The tong assembly 1 comprises a power tong 2 and a backup tong 3.

The power tong 2 comprises a pair of gates 4, 5 which are held together in the position shown by latch 6. When the latch 6 is released the gates 4, 5 can be swung open by admitting hydraulic fluid to piston and cylinder assemblies 7 and 8. The power tong 2 also contains a rotary 9 which is provided with four jaw assemblies 10. The rotary 9 can be rotated by a hydraulic motor 11.

The backup tong 3 is provided with two gates 12, 13 which are held together by latch 14 but which, when latch 14 is released can be swung to an open position.

In use, a lower length of casing (not shown), the upper end of which is provided with a socket, is gripped by slips. A stabbing guide is mounted on the socket and the pin of an upper length of casing is lowered into the stabbing guide.

Once the pin is correctly located the stabbing guide is removed. The gates 4,5 of the power tong 2 and the gates 12, 13 of the backup tong 3 are then opened and the tong assembly 1 moved towards the casing until the lower length of casing lies within the backup tong 3 and the upper length of casing lies within the power tong 2. The gates 4, 5, 12, 13 are then closed and latched. Jaw assemblies in the backup tong are then advanced to engage the lower length of casing whilst jaw assemblies in the power tong 2 are advanced to grip the upper length of casing. The hydraulic motor 11 is then actuated to turn the rotary 9 and rotate the upper length of casing relative to the lower length of casing. The tong assembly 1 is supported by a pneumatic lifting cylinder 15 which enables the power tong 2 to move towards the backup tong 3 as the pin enters the socket. Reaction forces are transmitted by columns 16 disposed to either side of the tong assembly 1 and by a series of levers in a known manner. It should be noted that the power tong 2 is free to move in a plane parallel to the backup tong 3 within certain limits.

Figure 2A:
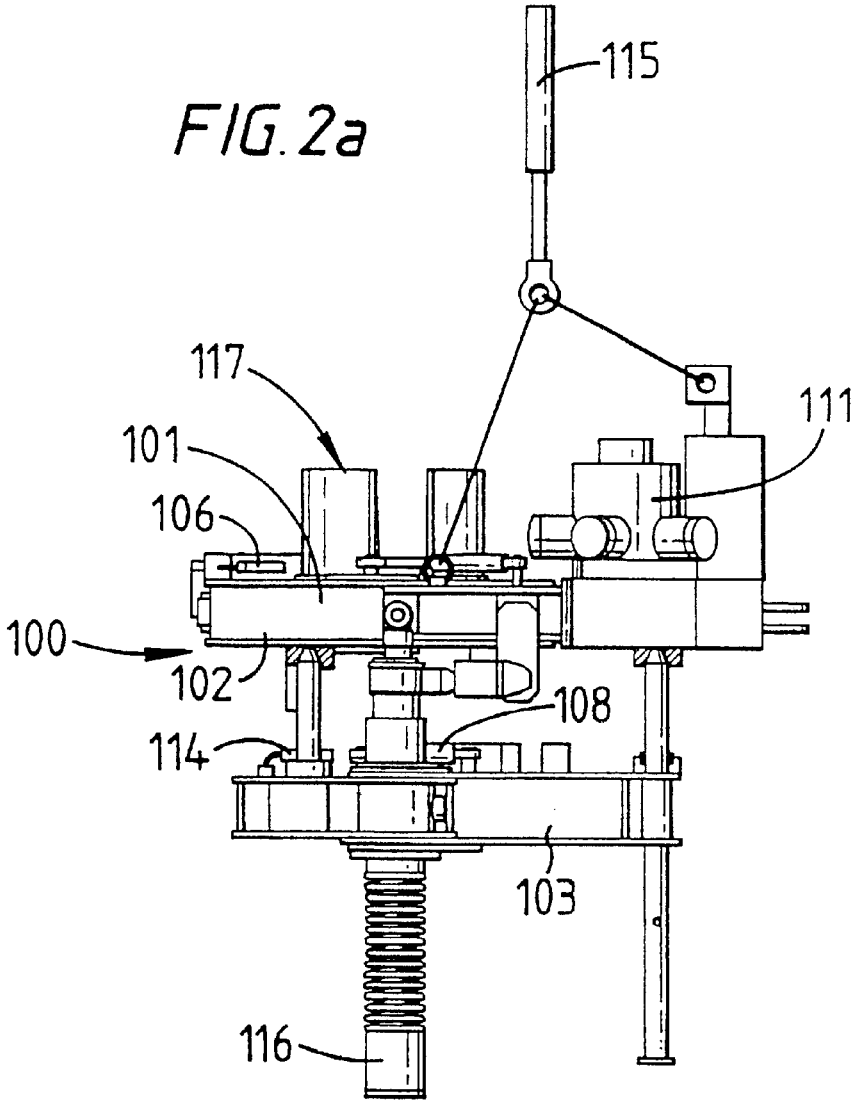
Figure 2B:
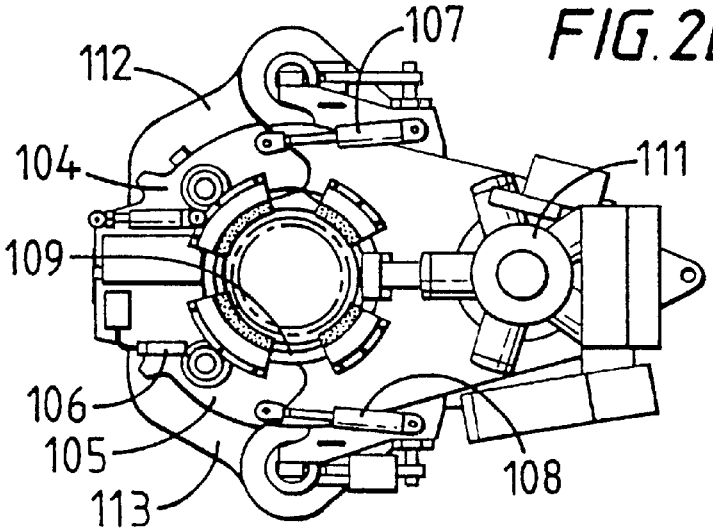

Referring now to FIGS. 2*a* and 2*b* there is shown an apparatus in accordance with the present invention which is generally identified by the reference numeral 100.

The apparatus 100 comprises a tong assembly 101 which is generally similar to the tong assembly 1 shown in FIGS. 1*a* and 1*b* and parts of the tong assembly 101 similar to the tong assembly 1 have been identified by similar reference numerals in the "100" series.

The main differences are that:

1. The top of the power tong 102 is provided with a guide 117;
2. The backup tong 103 is provided with jaw assemblies for accurately positioning the lower casing with respect to the backup tong 103; and
3. Means are provided for accurately aligning the power tong 102 with respect to the backup tong 103 and hence the guide 117 with the lower casing.

Turning firstly to the guide 117 it will be seen from FIG. 3 that this comprises four identical components 118 which are bolted to the top of the power tong 102. As best shown in FIG. 3*c* each component is tapered so as to guide the pin of an upper casing to the centre of the opening of the power tong 102.

Figure 4:
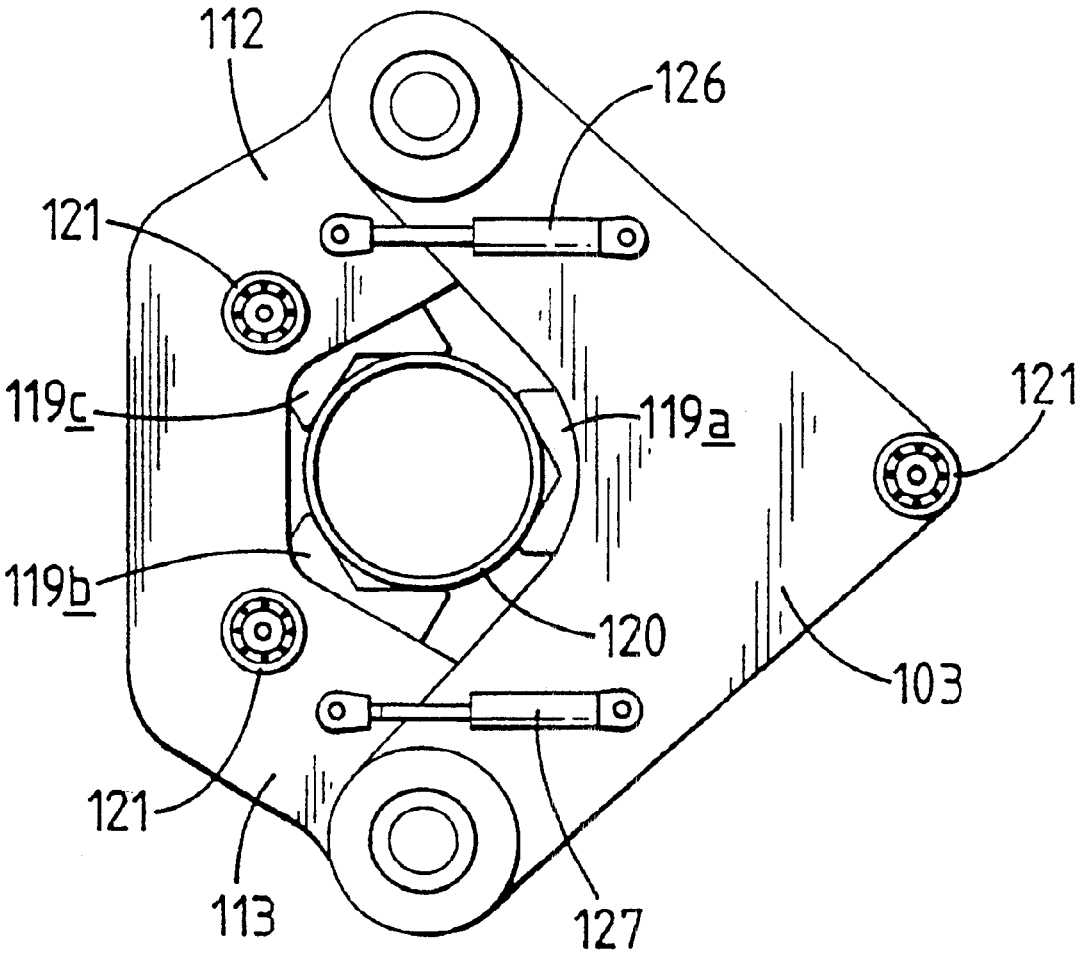
FIG. 4 is a top plan view of the backup tong forming part of the apparatus shown in FIGS. 2*a* and 2*b* with certain parts removed for clarity.

Referring now to FIG. 4, the backup tong 103 is provided with three prismatic jaw assemblies 119*a*, 119*b* and 119*c* which, when actuated, hold a lower length of casing 120 in a fixed position relative to the backup tong 103.

Figure 5:
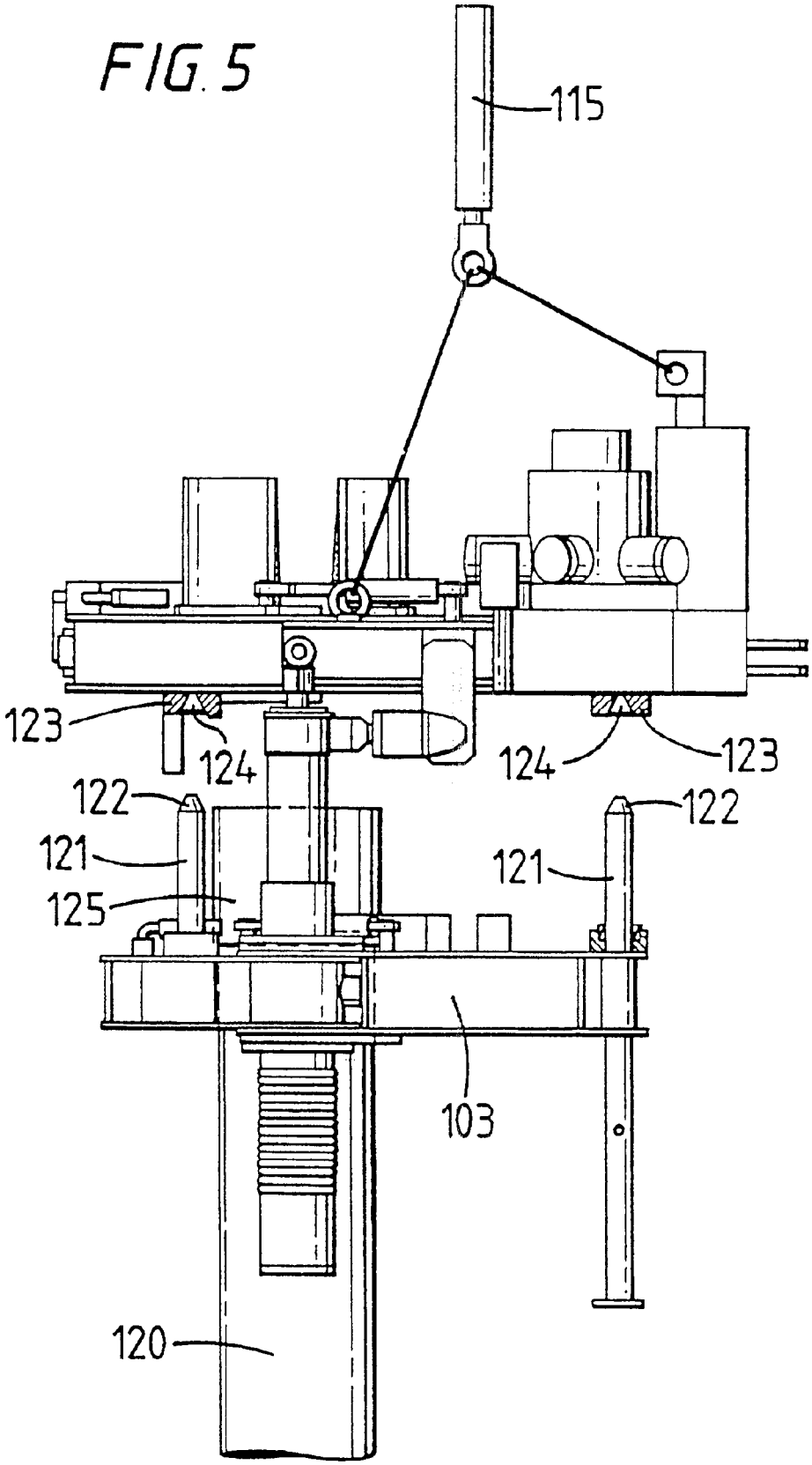
FIG. 5 is a side elevation of the apparatus shown in FIGS. 2*a* and 2*b* in a first position.

As shown in FIG. 5 the backup tong 3 is provided with three upwardly extending locating rods 121 which are each provided with a conical tip 122. Similar, the underside of the power tong 102 is provided with three blocks 123 each of which is provided with a recess 124 shaped to receive the conical tip 122 of a respective locating rod 121.

In use, the lower length of casing 120 is first secured by slips on the rig floor in the usual manner. The gates 112 and 113 of the backup tong 103 are then opened and the tong assembly 101 moved into position with the backup tong 103 circumjacent the lower length of casing 120 and immediately below the socket 125 thereof.

The gates 112 and 113 are then closed by hydraulic piston and cylinder assemblies 126 and 127 and the latch 114 closed. The prismatic jaw assembly 119*a* is fixed whilst prismatic jaw assemblies 119*b* and 119*c* are automatically advanced by a predetermined distance when the latch 114 is closed. This grips the lower length of casing firmly and also ensures that the backup tong 3 is in a fixed position relative to the lower length of casing 120. The position thusfar attained is shown in FIG. 5.

Figure 6:
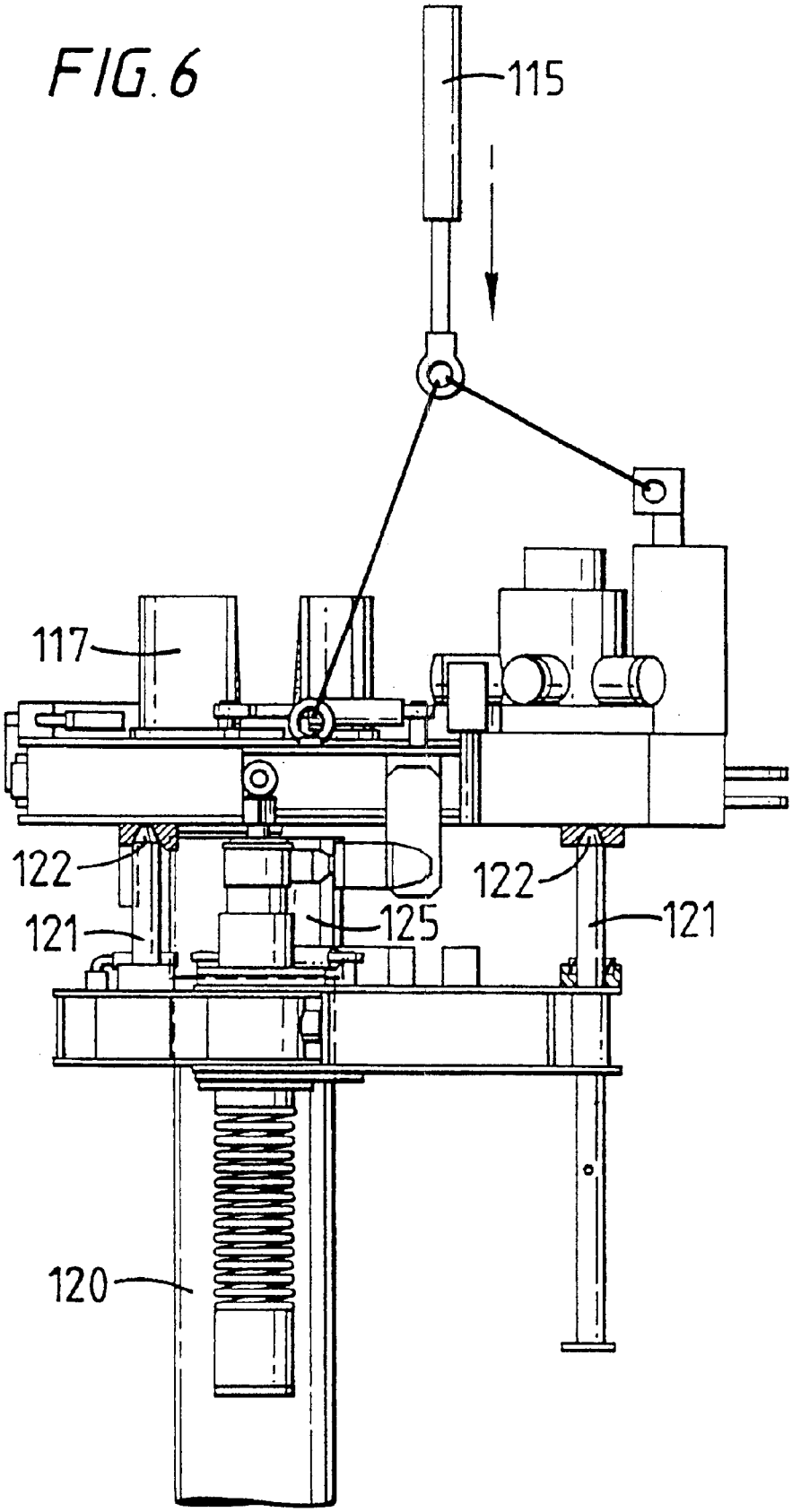
FIG. 6 is a side elevation of the apparatus shown in FIGS. 2*a* and 2*b* in a second position.

At this time pneumatic lifting cylinder 115 is extended which lowers the backup tong 3. The conical tips 122 of the locating rods 121 enter the recesses 124 of the blocks 123 and thus locate the power tong 2 with respect to the backup tong 3. This in turn locates the guide 117 with respect to the lower length of casing 120 so that the centre of the guide 117 is coaxial with the axis of the lower length of casing 120. This position is shown in FIG. 6.

Figure 7:
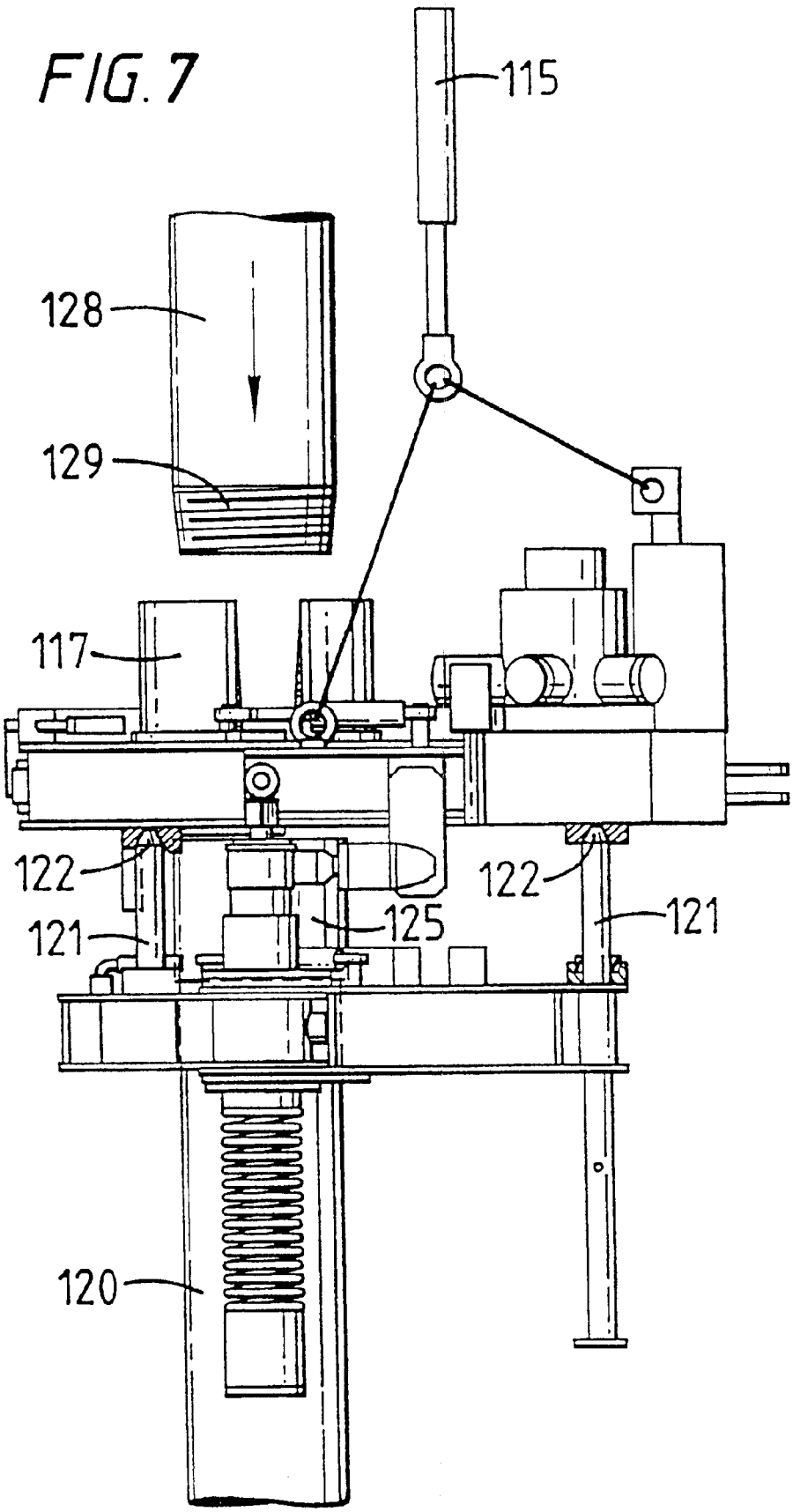
FIG. 7 is a side elevation of the apparatus shown in FIGS. 2*a* and 2*b* in a third position.

At this time the upper length of casing 128 is lowered into the proximity of the guide 117. As shown in FIG. 7 the lower end of the upper length of casing 128 is provided with a pin 129 which is tapered.

Figure 8:
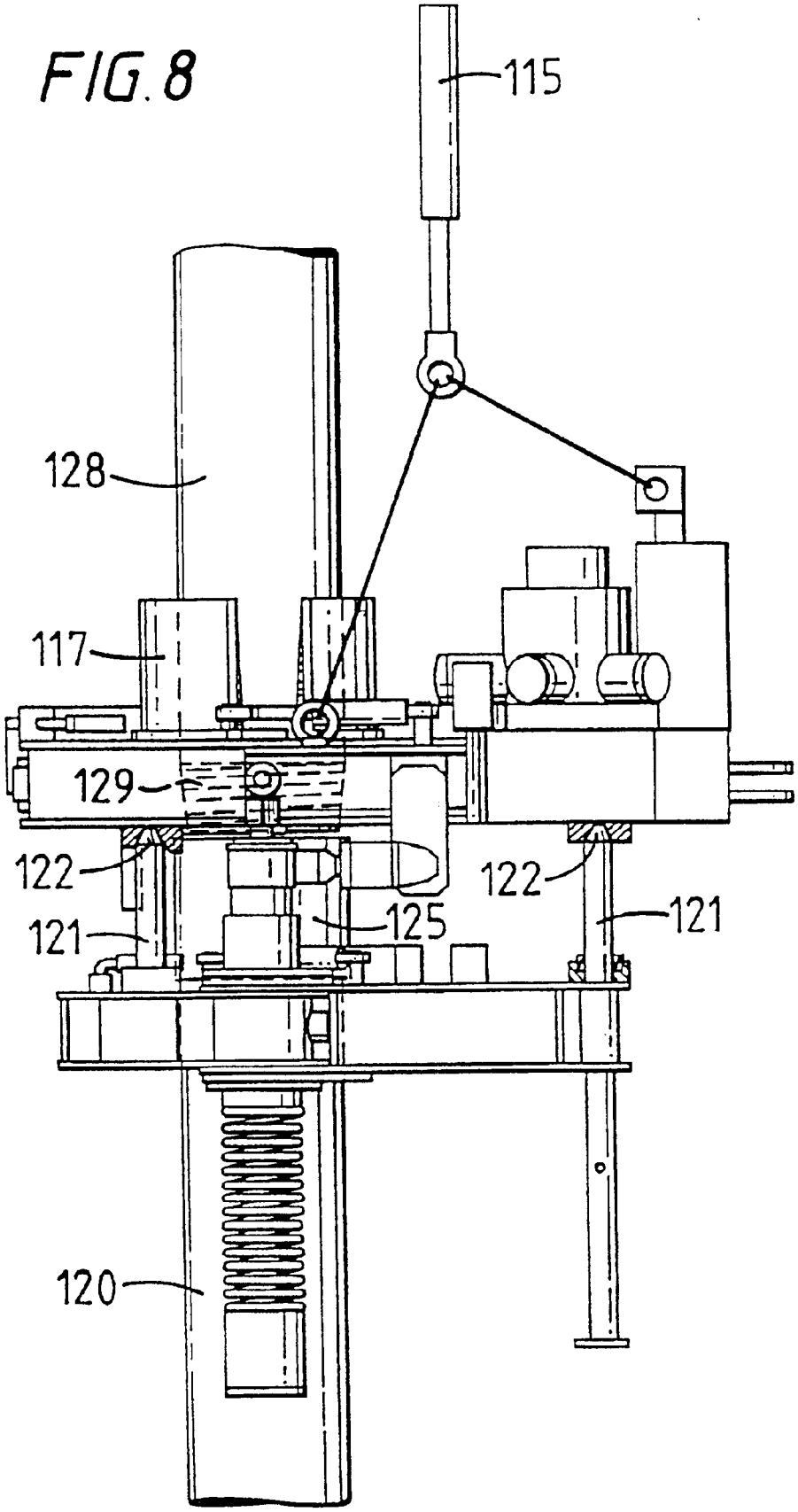
FIG. 8 is a side elevation of the apparatus shown in FIGS. 2*a* and 2*b* in a fourth position.
Figure 9:
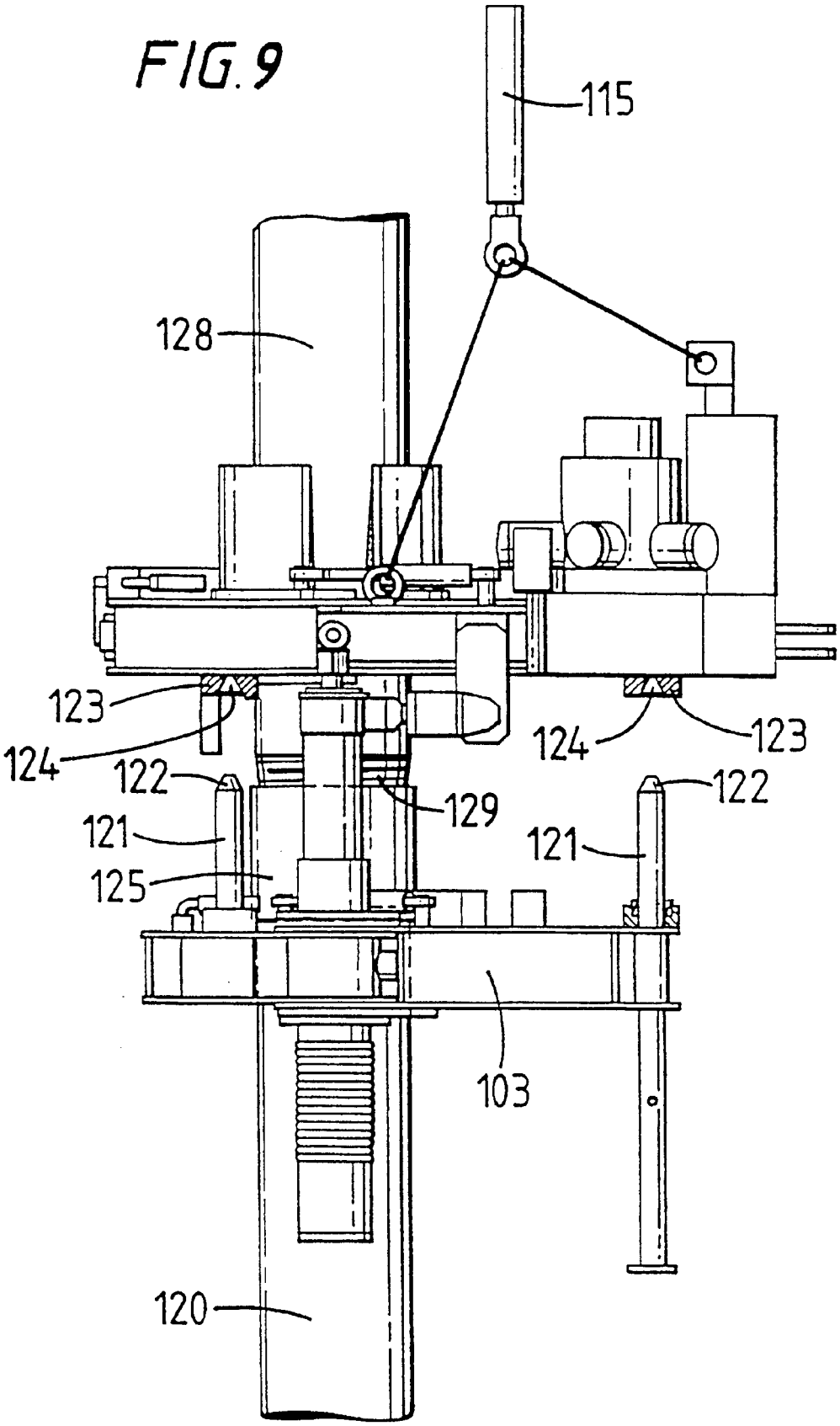
FIG. 9 is a side elevation of the apparatus shown in FIGS. 2*a* and 2*b* in a fifth position.

As the upper length of casing 128 is further lowered the pin 129 enters the guide 117 and is centred thereby. It then passes downwardly until it enters the socket 125 as shown in FIG. 8.

The power tong 102 is then raised so that the blocks 123 are well clear of the locating rods 121. At this point the jaw assemblies in the power tong 102 are applied to the upper length of casing 128 and the hydraulic motor 111 actuated to rotate the rotary and screw the pin 129 into the socket 125. During the procedure the power tong 102 moves towards the backup tong 103. However, even when the joint is tightened to the required torque the blocks 123 still lie a short distance above the conical tips 122 of the locating rods 121.

At this stage the jaw assemblies of both the power tong 102 and the backup tong 103 are relaxed, the gates 104, 105, 112 and 113 opened and the tong assembly 101 retracted in preparation for the casing being lowered. It will be noted that one component 118 of the guide 117 is mounted on each of the gates 104, 105 and accordingly the guide 117 opens and closes with the gates 104, 105.

For certain applications a backup tong is not required, for example where the power tong can conveniently be restrained by a chain attached to the drilling tower.

Figure 10:
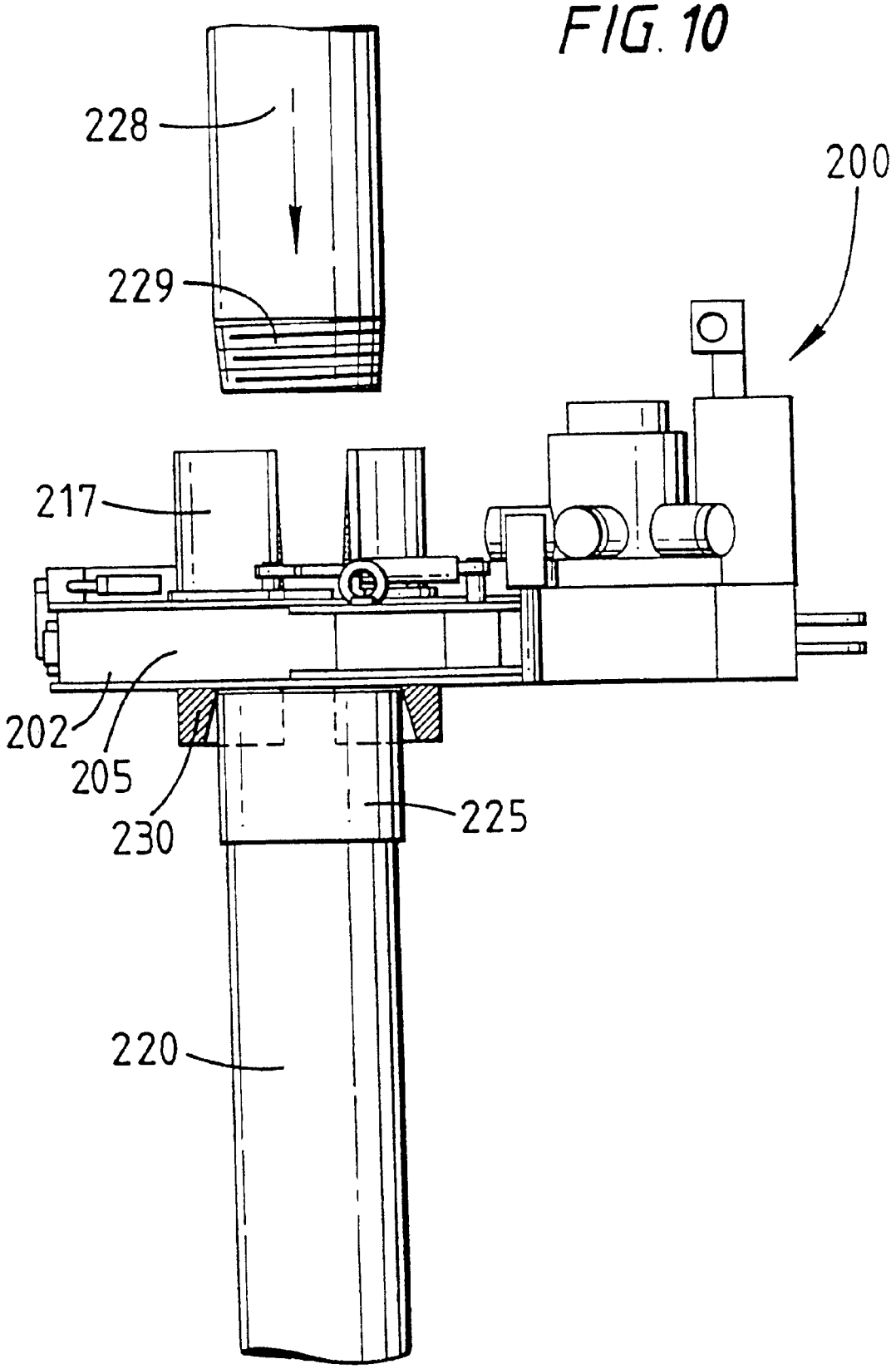
FIG. 10 is a side elevation of a second embodiment of an apparatus in accordance with the present invention.

FIG. 10 shows an apparatus in accordance with the present invention which is generally identified by the reference numeral 200.

The apparatus 200 comprises a power tong 202 which is generally similar to the power tong 2. The basic construction of the power tong 202 is similar to the power tong 2 and parts having similar functions have been identified by the same reference numeral in the "200" series.

The main differences are that the apparatus 200 does not include a backup tong and that it is provided with a guide 217 and a socket centraliser 230.

In use, the lower length of casing 220 is first secured by slips (not shown) with the socket 225 facing upwardly close to the slips.

The power tong 202 is then lowered onto the socket 225 so that the socket 225 enters the socket centraliser 230 and aligns the socket centraliser 230, the socket 225 and the guide 217.

The upper length of casing 228 is then lowered so that its pin 229 enters the guide 217, is centred thereby and enters the socket 225. At this point power tong 202 is raised. Its jaw assemblies are then advanced to grip the upper length of casing 228 which is then rotated to screw the pin 229 into the socket 225.

Once the joint is tightened to the required torque the gates 204, 205 are opened and the power tong 202 withdrawn.

Figure 11:
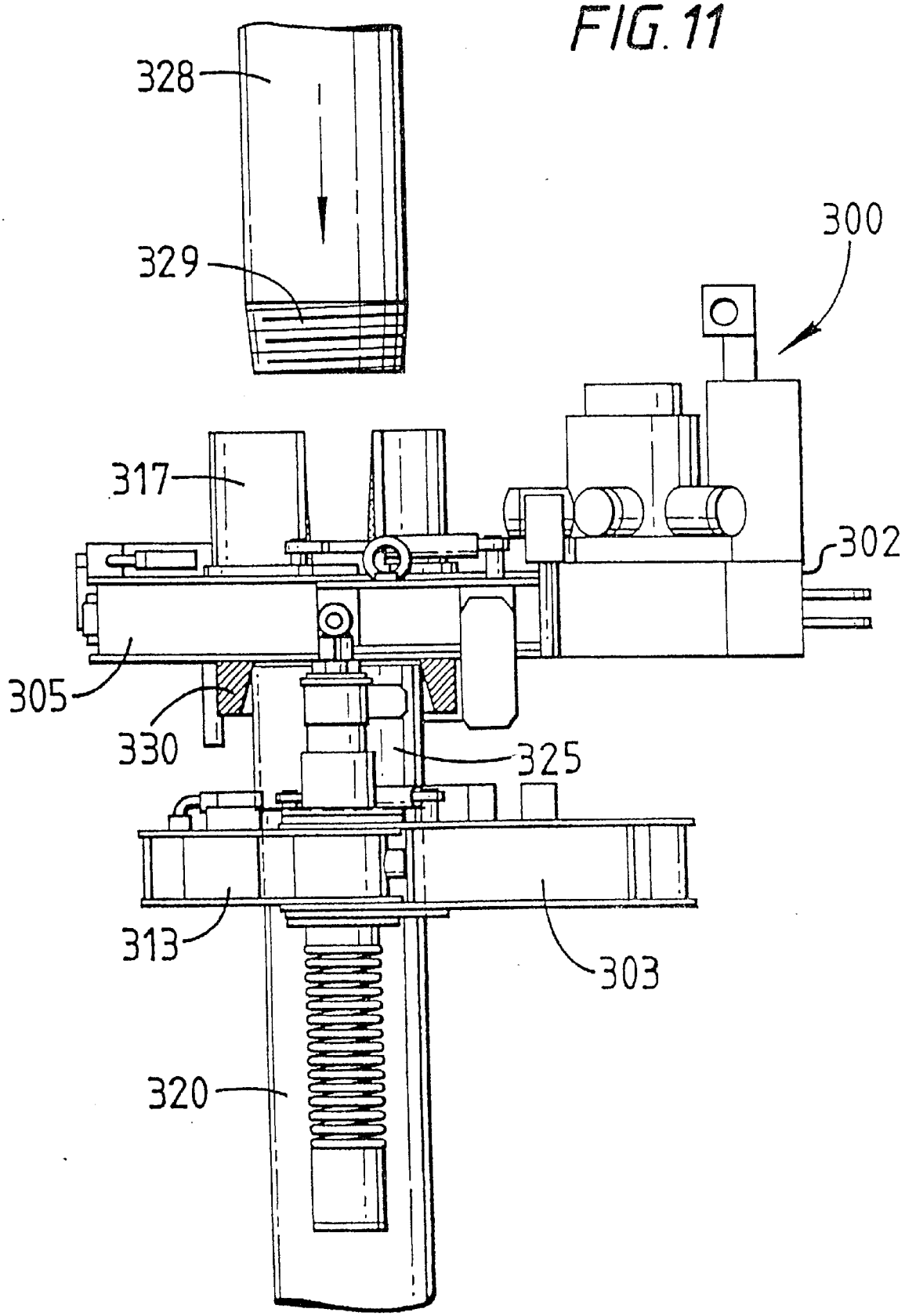
FIG. 11 is a side elevation of a third embodiment of an apparatus in accordance with the present invention.

The embodiment shown in FIG. 11 is generally similar to that shown in FIG. 10 except that the apparatus 300 also includes a backup tong 303.

Since the upper length of casing 328 and the lower length of casing 320 are being aligned by the guide 317 and the socket centraliser 330 no special arrangements need be made for aligning the power tong 302 and the backup tong 303.

The procedure for connecting the upper length of casing 328 to the lower length of casing 320 is as follows.

Firstly, the lower length of casing 320 is secured in slip (not shown).

The gates 312, 313 of the backup tong are then opened and the apparatus 300 manoeuvred so that the lower length of casing 320 is disposed within the backup tong 303.

The power tong 302 is then lowered until the socket 325 on the lower length of casing 320 is received within the socket centraliser 330.

The upper length of casing 328 is then lowered until the pin 329 passes through guide 317 and enters the socket 328.

Only at this stage are gates 312, 313 closed and the jaw assemblies of the backup tong 303 activated to grip the lower length of casing 320.

The power tong 302 is then raised and its jaw assemblies activated to grip the upper length of casing 328 which is then rotated to cause the pin 329 to enter the socket 325 and the joint to be tightened to the desired torque.

The jaw assemblies are then relaxed and the gates 304, 305, 312, 313 of the power tong 302 and the backup tong 303 opened prior to retracting the apparatus 300.

Various modifications to the embodiments described are envisaged, for example, if desired, the guide and the socket centraliser could be mounted on the backup tong 303 rather than the power tong 302. Alternatively, the guide could be mounted on the backup tong without a socket centraliser. Such an arrangement is shown in FIG. 12.

Figure 12:
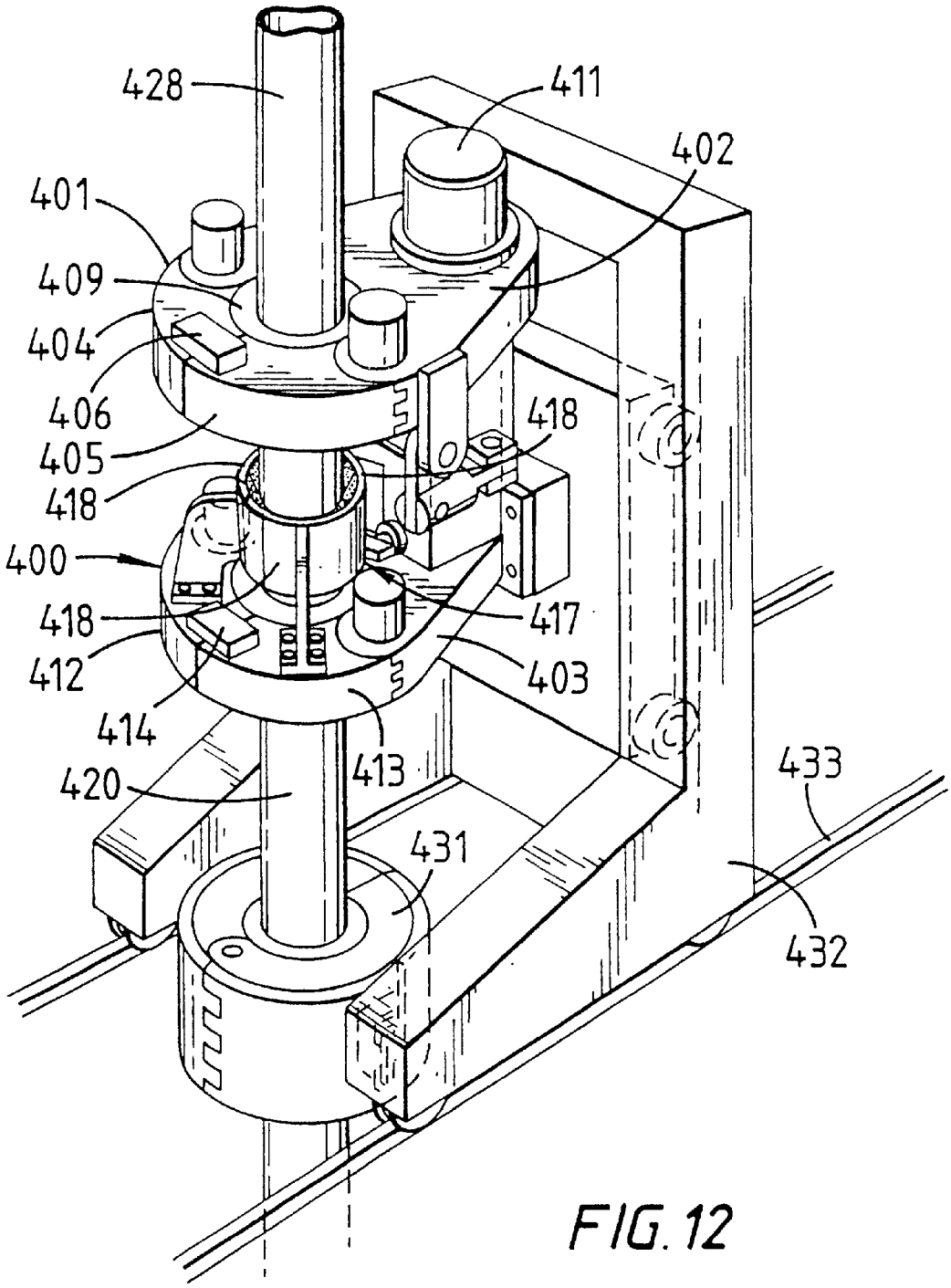
FIG. 12 is a perspective view of a fourth embodiment of an apparatus in accordance with the present invention.

The embodiment shown in FIG. 12 is generally similar to that shown in FIG.1*a* and 1*b* and parts of the tong assembly 401 similar to the tong assembly 1 have been identified by similar reference numerals in the "400" series.

The main difference is that the top of the backup tong 403 is provided with a guide 417.

In use, the lower length of casing 420 is first secured by stops 431 on the rig floor in the usual manner. The gates 412 and 413 of the backup tong 403 are then opened. Since two of the four components 418 of the guide 417 are mounted on the gates 412 and 413 the guide 417 opens with the gates 412 and 413 so that the lower length of casing 420 can enter the backup tong 403 when the carriage 432 which supports the apparatus 400 is advanced towards the casing 420 on rails 433.

When the lower length of casing 420 is fully within the backup tong 403 the gates 412 and 413 are closed. The components 418 of the guide 417 have a stepped interior (not visible in FIG. 12) so that the lower part of each component 418 touches the socket on the top of the lower length of casing 420 whilst the upper part of the interior of each component 418 tapers inwardly to form a funnel. Once the lower length of casing 420 has been gripped the upper length of casing 428 is lowered through the power tong 402 towards the lower length of casing 420. The guide 417 guides the pin on the bottom of the upper length of casing 428 into the socket. The power tong 402 is disposed a small distance above the guide 417. Once the pin of the upper length of casing 428 has entered the socket on the lower length of casing the jaws of the power tong 402 are applied to the upper length of casing 428 which is rotated until the joint reaches the desired torque. Thereafter, gates 404, 405, 412, 413 are opened and the assembly 400 retracted on the carriage 432.

What is claimed is:

1. An apparatus for aligning a first tubular and a second tubular, the first tubular extending through a power tong and the second tubular extending through a backup tong, the apparatus comprising positioning apparatus for guiding the power tong with respect to the backup tong and for maintaining said power tong and said backup tong in a certain juxtaposition during a tubular stabbing operation, the positioning apparatus comprising a plurality of spaced-apart locating rods projecting from one of said power tong and said backup tong and a plurality of spaced-apart blocks on the other of said power tong and said backup tong, and each block having a recess shaped to receive an end of one of the plurality of spaced-apart locating rods.

2. The apparatus of claim 1 wherein said backup tong is provided with at least two prismatic jaw assemblies to locate said backup tong in fixed juxtaposition with respect to the second tubular.

3. The apparatus of claim 1 wherein said plurality of spaced-apart locating rods are on said backup tong and said plurality of spaced-apart blocks are on said power tong.

4. The apparatus of claim 1 wherein said plurality of spaced-apart locating rods are on said power tong and said plurality of spaced-apart blocks are on said backup tong.

5. The apparatus of claim 1 further comprising a tubular guide projecting from the power tong for guiding a tubular with respect to the power tong.

6. The apparatus of claim 1 further comprising a tubular guide projecting from the backup tong for guiding a tubular with respect to the backup tong.

7. A method of coupling tubulars using an apparatus comprising positioning apparatus for guiding a power tong with respect to a backup tong and for maintaining said power tong and said backup tong in a certain juxtaposition during a tubular stabbing operation, the positioning apparatus comprising a plurality of spaced-apart locating rods projecting from one of said power tong and said backup tong and a plurality of spaced-apart blocks on the other of said power tong and said backup tong, each block having a recess shaped to receive an end of one of the plurality of spaced-apart locating rods, the method comprising gripping a lower tubular provided with a socket with the backup tong, positioning said power tong relative to said backup tong with said positioning apparatus, maintaining said power tong and said backup tong in said certain juxtaposition, lowering an upper tubular having a pin and allowing said pin to enter said socket, raising said power tong, and gripping said upper tubular and rotating said upper tubular so that said pin is screwed into said socket.

8. A method for aligning tubulars, the method comprising, positioning with positioning apparatus a power tong with respect to a backup tong, the backup tong supporting a first tubular, the positioning apparatus comprising positioning apparatus for guiding the power tong with respect to the backup tong and for maintaining said power tong and said backup tong in a certain juxtaposition during a stabbing operation, the positioning apparatus comprising a plurality of spaced-apart locating rods projecting from one of said power tong and said backup tong and a plurality of spaced-apart blocks on the other of said power tong and said backup tong, each block having a recess shaped to receive an end of one of the plurality of spaced-apart locating rods, said power tong having a tubular guide projecting therefrom for guiding a tubular, gripping the first tubular with the backup tong, positioning said power tong relative to said backup tong with said positioning apparatus, maintaining said power tong and said backup tong in said certain juxtaposition, guiding a second tubular into alignment with the first tubular with the tubular guide, and moving the second tubular into contact with the first tubular for connection therewith.

9. The method of claim 8 further comprising using said power tong to connect said second tubular to said first tubular.

* * * * *